United States Patent [19]

Sorimachi

[11] Patent Number: 4,824,402

[45] Date of Patent: Apr. 25, 1989

[54] CONNECTOR PLUG

[75] Inventor: Mitsuo Sorimachi, Isesaki, Japan

[73] Assignee: Hosiden Electronics Co., Ltd., Osaka, Japan

[21] Appl. No.: 124,651

[22] Filed: Nov. 24, 1987

[30] Foreign Application Priority Data

Dec. 26, 1986 [JP] Japan ..... 61-201765[U]

[51] Int. Cl.[4] ..... H01R 13/648

[52] U.S. Cl. ..... 439/680

[58] Field of Search ..... 439/680, 607, 677

[56] References Cited

U.S. PATENT DOCUMENTS 4,109,987 8/1978 Bourdon ..... 439/680 X 4,423,919 1/1984 Hillis ..... 439/680 X 4,443,052 4/1984 Eaby et al. ..... 439/680 X

*Primary Examiner*—John D. Lee

*Assistant Examiner*—Phan T. Heartney

*Attorney, Agent, or Firm*—Pollock, Vande Sande and Priddy

[57] ABSTRACT

A connector plug, for engagement with a connector socket, has a main positioning protrusion extending from the front marginal edge of a cylindrical metal cover in its axial direction and protruding outwardly from its outer peripheral surface. The cylindrical metal cover also includes a cut-away portion, along its front marginal edge, which defines two corner portions that cooperate with the main positioning protrusion to position the connector plug relative to the connector socket.

4 Claims, 2 Drawing Sheets

CONNECTOR PLUG

BACKGROUND OF THE INVENTION

The present invention relates to a connector plug which is used for interconnecting audio-equipments, video-equipments, computers, and their peripheral equipments.

A typical prior art example of this kind of connector plug is disclosed in U.S. Pat. No. 4,684,199.

FIG. 1 shows the structure of this conventional connector plug, which is identified generally by 100. The connector plug 100 comprises a cylindrical metal cover 101, which accommodates a disc-shaped insulating body 102 fitted thereinto. A plurality of contact pins 103*a* to 103*e* are planted on the insulating body 102 in a manner to extend therethrough in the axial direction of the cylindrical metal cover 101.

The rear portion of the cylindrical metal cover 101 is fitted with an insulating cap 104. The insulating cap 104 is formed of a flexible insulating resinous material and has a rear cable lead-out portion 105 which has a number of slits and hence is elastic.

The exposed front portion of the cylindrical metal cover 101 has three protrusions or ridges 106, 107*a* and 107*b* which protrude radially inwardly from the inner cylindrical surface of the metal cover 101. The ridge 106 serves as a main positioning ridge and the other ridges 107*a* and 107*b* as auxiliary positioning ridges.

The cylindrical metal cover 101 has a cut-away part 108 open at its front end, extending between the auxiliary positioning ridges 107*a* and 107*b*. The cut-away part 108 is provided for avoiding abutment of the metal cover 101 against an internal part of the mating connector socket 200 shown in FIG. 2 and permits miniaturization of the socket. The connector socket is disclosed in, for example, U.S. Pat. No. 4,637,669.

The insulating body 102 has an insulating bar-like member 109 formed integrally therewith and extending forwardly from the front end face thereof together with the contact pins 103*a* and 103*e*. The insulating bar-like member 109 is provided at a different position according to the number of contact pins which are planted on the insulating body 102. The mating connector socket has a squarely-sectioned guide hole 201 for receiving the insulating bar-like member 109, and this ensures insertion of the connector plug into a mating socket of desired contact pin member.

The insulating bar-like member 109 is formed so that it extends slightly forwardly of the contact pins 103*a* to 103*e* but rearwardly of the front ends of the ridges 106, 107*a* and 107*b*. The connector plug 100 is inserted into the connector socket 200 in the following way. At first, the front circumferential edge of the cylindrical metal cover 101 of the connector plug 100 is inserted into an annular gap defined by an insulating body 204 and a cylindrical metal cover 206 of the connector socket 200 therebetween and then the connector plug 100 is turned, bringing the main positioning ridge 106 and the auxiliary positioning ridges 107*a* and 107*b* into engagement with grooves 202, 203*a* and 203*b* formed in the connector socket 200. In this instance, when the connector plug 100 is being turned about its axis for positioning, the tip of the insulating bar-like member 109 does not abut the front end face of the insulating body 204. It is only when the ridges 106, 107*a* and 107*b* have been brought into alignment with the grooves 202, 203*a* and 203*b* of the connector socket 200 by turning the connector plug 100 that the insulating bar-like member 109 can be inserted into the guide hole 201, and accordingly the contact pins 103*a* to 103*e* can be inserted into corresponding contact receiving holes 205*a* to 205*e* in the socket 200.

The prior art connector plug has its feature in that the main positioning ridge 106 and the auxiliary positioning ridges 107*a* and 107*b* engage the grooves 202, 203*a* and 203*b* formed in the peripheral surface of the insulating body 204 of the connector socket 200, defining the position where to insert the connector plug 100 into the socket 200.

The connector plug 100 is turned with the main positioning ridge 106 and the auxiliary positioning ridges 107*a* and 107*b* held in sliding contact with the marginal portion of the front end face of the insulating body 204 of the connector socket 200 until the plug inserting position is found. Accordingly, the front ends of the protrusions 106, 107*a* and 107*b* support the plug 100 at three points, enabling the plug 100 to be turned with its axis aligned with that of the socket 200.

In the connector socket 200 shown in FIG. 2, the insulating body 204 has an annular groove 207 formed in its front end face circumferentially thereof, and a cylindrical metal cover 206 is installed in the annular groove 207. The cylindrical metal cover 206 is formed by pressing a resilient metal sheet into a cylindrical form so that the opposing side edges are adjacent but spaced a certain distance apart, defining a slit 206A axially of the cover 206. The cylindrical metal cover 206 of such a configuration is disposed in the annular groove 207 with the slit 206A in agreement with the main positioning groove 207. The cylindrical metal cover 206 thus installed in the annular groove 207 is resiliently deformable radially thereof, and hence firmly grips the outer peripheral surface of the cylindrical metal cover 101 of the connector plug 100 inserted in the connector socket 200. Accordingly, the connector socket 200, though small in size, has a strong plug engaging force.

While in the above reference has been made to the connector plug with five contact pins and the mating connector socket, examples of connector plugs having different number of contact pins and a connector plug without the insulating bar-like member 109 are set forth in the afore-mentioned U.S. Pat. No. 4,684,199; accordingly, no description will be given of such prior art connector plugs.

Any of such conventional connector plugs is positioned, relative to the main positioning groove 202 and the auxiliary positioning grooves 203*a* and 203*b* of the connector socket 200, by turning the connector plug with its three protrusions 106, 107*a* and 107*b* held in sliding contact with the front end face of the insulating body 204 of the connector socket 200. In this positioning, the center axis of the connector plug can be held substantially in its correct direction because the plug is turned with the front marginal portion of the cylindrical metal cover 101 held in shallow engagement with the cylindrical metal cover 207 of the connector socket 200. However, there is a case where the front ends of the three protrusions 106, 107*a* and 107*b* do not accurately coincide one another in position within a predetermined tolerance owing to distribution in size. Furthermore, even if the three protrusions are formed accurately at predetermined positions, the connector plug may sometimes be held with its center axis slightly aslant. In these cases, the three protrusions do not simultaneously contact the marginal portion of the front end face of the insulating body 204 of the connector socket 200. In other words, only two or one of the three protrusions makes sliding contact with the front end face of the insulating body 204. As a result of this, the pressure of contact between the two or one protrusion and the insulating body 204 is greater than in the case where all the three protrusions are held in contact with the latter, and there is a tendency that during the rotational positioning of the plug the protrusion contacting the front end face of the insulating body 204 scratches its marginal portion and front edges of the grooves 202, 203*a* and 203*b* due to friction, scraping a resin powder off the insulating body 204. This introduces the possibility that the resin powder enters into the female contact receiving holes 205*a* to 205*e* of the connector socket 200, resulting in bad contact between the contact pins of the plug and female contacts of the socket.

SUMMARY OF THE INVENTION

It is therefore an object of the present invention to provide a connector plug which can be used with conventional connector sockets and where in the positioning protrusions will not scrape against the insulating body of the mating connector socket.

The cylindrical metal cover of the connector plug according to the present invention has, near its front end portion, a main positioning protrusion which protrudes outwardly thereof. Where the cylindrical metal cover has auxiliary positioning protrusions in addition to the main positioning protrusions, they are formed so that the front end of the main positioning protrusion may lie forwardly of the front ends of the auxiliary positioning protrusions.

With the plug structure of the present invention, the front end portion of the main positioning protrusion and at least two points on the outer marginal edge of the front open end of the cylindrical metal cover make sliding contact with an inner surface of a tapered front end portion of the cylindrical metal cover of the mating connector socket while the plug is turned until the main positioning protrusion engages the slit of the cylindrical metal cover of the socket.

According to the present invention, since the main positioning protrusion protrudes outwardly from the outer cylindrical surface of the metal cover, it makes contact with the inner surface of the tapered front end portion of the cylindrical metal cover of the mating connector socket during the rotational positioning of the connector plug relative thereto. By turning the connector plug, the main positioning protrusion is brought into engagement with the slit of the cylindrical metal cover of the connector socket, unequivocally positioning the connector plug relative thereto. Accordingly, there is no chance for the main and auxiliary positioning protrusions to contact the insulating body of the mating connector socket. Thus the plug inserting position can be found without scratching the insulating body of the connector socket by the positioning protrusions.

DESCRIPTION OF THE PREFERRED EMBODIMENTS

Figure 3:
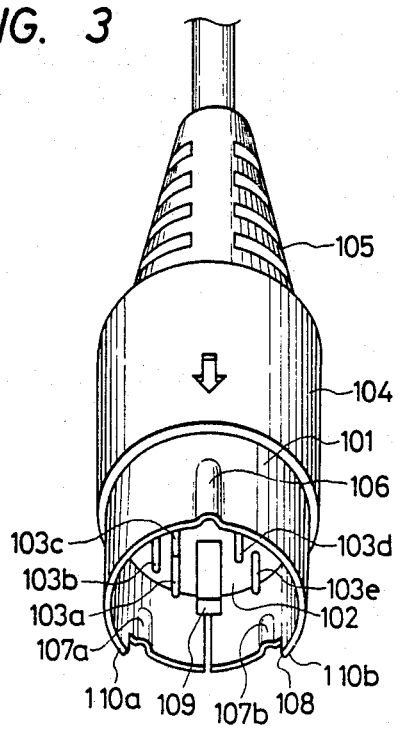
FIG. 3 is a perspective view illustrating the structure of the connector plug of the present invention.

FIG. 3 illustrates an embodiment of the connector plug of the present invention. In FIG. 3 the parts corresponding to those in FIG. 1 are identified by the same reference numerals.

Figure 1:
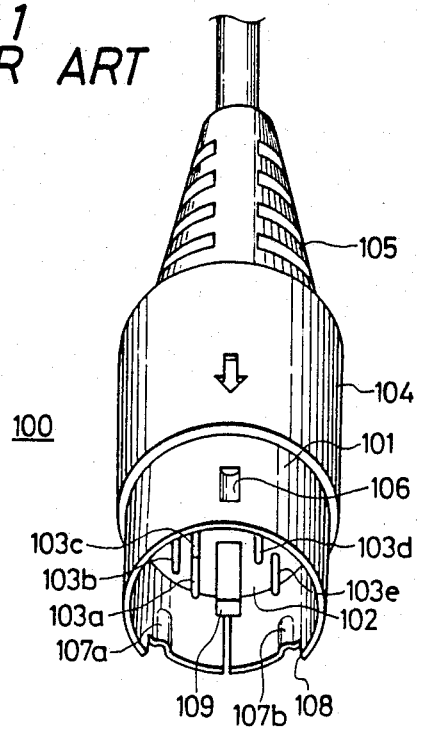
FIG. 1 PRIOR ART
FIG. 1 is a perspective view showing a conventional connector plug.
Figure 2:
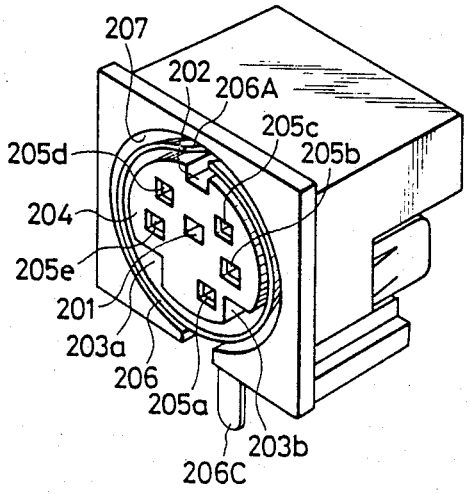
FIG. 2 PRIOR ART
FIG. 2 is a perspective view of the conventional connector socket.

The connector plug of the present invention is basically identical in structure with the prior art example shown in FIG. 1. That is, the connector plug of the present invention comprises the cylindrical metal cover 101, the insulating body 102 fitted thereinto, the contact pins 103*a* to 103*e* planted on the insulating body 102, the insulating cap 104 fitted on the rear portion of the cylindrical metal cover 101, and the cable lead-out portion 105 formed integrally with the insulating cap 104 at the rear end thereof. The cylindrical metal cover 101 has the cut-away portion 108 open at its front end and the auxiliary positioning protrusions 107*a* and 107*b* formed in the front marginal portion of the cut-away portion 108. The insulating body 102 has the insulating bar-like member 109 formed integrally therewith and extending forwardly of its front end face.

The structural feature of the connector plug of the present invention resides in that the main positioning protrusion 106 sticks out from the outer peripheral surface of the cylindrical metal cover 101 and extends backwardly of its front marginal edge.

With such a structure as mentioned above, the front end of the main positioning protrusion 106 makes sliding contact with a tapered front end portion 206B raised about the periphery of the front open end of the cylindrical metal cover 206 of the mating connector socket 200 (see FIG. 4) during rotational positioning of the connector plug relative thereto. Accordingly, the protrusion 106 can unequivocally be positioned relative to the slit 206A of the cylindrical metal cover 206.

Figure 4:
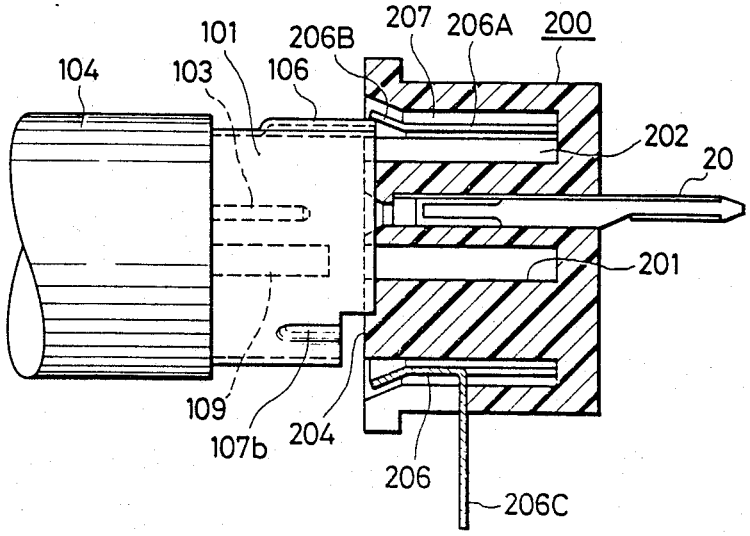
FIG. 4 is a diagram, partly in section, illustrating the positional relationship between the connector plug shown in FIG. 3 and the mating connector socket.

In the embodiment shown in FIG. 3, since the cylindrical metal cover 101 has the cut-away portion 108 extending along its front marginal edge, at least corner portions 110*a* and 110*b* at opposite ends of the cut-away portion 108 and the front end portion of the main positioning protrusion 106 abut against the tapered front end portion 206B of the cylindrical metal cover 206 of the mating connector socket 200. This permits rotational positioning of the connector plug 100 with its center axis held substantially in alignment with that of the connector socket 200. As will be appreciated from the above, the opposite corner portions 110*a* and 110*b* of the cut-away portion 108 made in the cylindrical metal cover 206 of the conventional connector plug produce a new effect i.e. they assist in the rotational positioning of the connector plug 100 in cooperation with the main positioning protrusion 106. The auxiliary positioning protrusions 107*a* and 107*b* will never contact the insulating body 204 of the connector socket 200, as depicted in FIG. 4, until after the main positioning protrusion 106 has been brought into engagement with the slit 206A of the cylindrical metal cover 206 of the connector socket 200 through the rotational positioning of the connector plug 100. Accordingly, there is no possibility of scraping marginal edge of the front end face of the insulating body 204 of the connector socket 200 during the rotational positioning of the connector plug 100 relative thereto.

Thus the connector plug of the present invention is entirely free from the defect that resin powder will be scraped off the insulating body 204 of the connector socket and enter into its female contact receiving holes, leading to bad contact between the contact pins of the plug and the female contacts of the socket.

Due to the provision of corner portions 110*a* and 110*b*, the auxiliary positioning protrusions 107*a* and 107*b* may be dispensed with but are preferably retained for ensuring snug engagement between the plug 100 and the socket 200. Moreover, the main positioning groove 202 of the socket 200 may also be omitted but is preferably retained for receiving a switch actuator in the case of a socket with a switch.

While the present invention has been described as being applied to a connector plug having five contact pins, it can readily be understood that the invention is also applicable to connector plugs having three to eight contact pins.

It will be apparent that many modifications and variations may be effected without departing from the scope of the novel concepts of the present invention.

What is claimed is:

1. A connector plug comprising:

a disc-shaped insulating body holding a plurality of contact pins;

a cylindrical metal cover having said insulating body fitted therein;

a main positioning protrusion extending from the front marginal edge of said cylindrical metal cover in its axial direction and protruding outwardly from the outer peripheral surface of said cylindrical metal cover;

a flexible insulating cap fitted on the rear portion of the cylindrical metal cover; and a cut-away portion cut in the front marginal edge of said cylindrical metal cover along a part of the circumference of said front edge, said cut-away portion defining two corner portions in the front marginal edge of said cylindrical metal cover at opposite ends of said part of said circumference which corner portions cooperate with said main positioning protrusion to position said connector plug relative to a socket into which said plug is inserted.

2. The connector plug of claim 1, further including at least one auxiliary positioning protrusion which extends from the front marginal edge of the said cut-away portion of the cylindrical metal cover in its axial direction and protrudes inwardly from the inner peripheral surface of said cylindrical metal cover.

3. The connector plug of claim 2, wherein the insulating body has an insulating bar-like member formed integrally therewith and extending from its front end face in its axial direction to a position intermediate between the front end of the auxiliary positioning protrusion and the tip of each contact pin.

4. The connector plug of claim 1, wherein the insulating body has an insulating bar-like member formed integrally therewith and extending from its front end face in its axial direction to a position between the front end of said main positioning protrusion and the tip of each contact pin.

* * * * *